US011129423B2

(12) United States Patent
Zeppetella

(10) Patent No.: US 11,129,423 B2
(45) Date of Patent: Sep. 28, 2021

(54) OUTERWEAR GARMENT FOR USE WITH A FALL-ARREST HARNESS

(71) Applicant: Pietro Zeppetella, St. Catherines (CA)

(72) Inventor: Pietro Zeppetella, St. Catherines (CA)

( * ) Notice: Subject to any disclaimer, the term of this patent is extended or adjusted under 35 U.S.C. 154(b) by 217 days.

(21) Appl. No.: 16/332,841

(22) PCT Filed: Sep. 13, 2016

(86) PCT No.: PCT/CA2016/051077
§ 371 (c)(1),
(2) Date: Mar. 13, 2019

(87) PCT Pub. No.: WO2018/049501
PCT Pub. Date: Mar. 22, 2018

(65) Prior Publication Data

US 2019/0216142 A1 Jul. 18, 2019

Related U.S. Application Data

(63) Continuation-in-part of application No. 14/685,022, filed on Apr. 13, 2015, now abandoned.

(51) Int. Cl.
*A41D 13/00* (2006.01)
*A62B 35/00* (2006.01)

(52) U.S. Cl.
CPC ..... *A41D 13/0007* (2013.01); *A62B 35/0037* (2013.01)

(58) Field of Classification Search
CPC ..... A41D 13/0007; A41D 2600/108; A62B 35/0037; A62B 35/0043
USPC ..... 2/94
See application file for complete search history.

(56) References Cited

U.S. PATENT DOCUMENTS 2,979,153 A * 4/1961 Hoagland ..... A41D 13/0007 182/3
3,973,643 A 8/1976 Hutchinson
4,177,877 A 12/1979 Gallinati
4,731,882 A * 3/1988 Ekman ..... A62B 35/0031 2/69
5,265,782 A 11/1993 Rubin et al.
(Continued)

FOREIGN PATENT DOCUMENTS

WO 03082034 10/2013

OTHER PUBLICATIONS

Form PCT/ISA/237 Written Opinion dated May 19, 2017 in relation to PCT/CA2016/051077, filed on Sep. 13, 2016.
(Continued)

*Primary Examiner* — Alissa L Hoey
(74) *Attorney, Agent, or Firm* — Norton Rose Fulbright Canada LLP

(57) ABSTRACT

An outerwear garment for use with a fall-arrest harness devised to permit a fall-arrest harness to be worn underneath an outerwear garment body, such as a jacket, vest, or coat, between an aperture on a rear side thereof and a Dee-ring access flap covering the aperture. A plurality of fasteners disposed on each of the rear side adjacent the access flap and along the perimeter of the access flap permits the access flap to be automatically opened for access to the fall-arrest harness. Lanyard hook-receiving members disposed on a front side of the garment body also permit hanging of lanyard hooks thereon during periods of non-use.

7 Claims, 9 Drawing Sheets

(56) References Cited

U.S. PATENT DOCUMENTS

| | | | | |
|---|---|---|---|---|
| 6,101,631 | A | 8/2000 | Ferguson, Jr. | |
| 6,128,782 | A | 10/2000 | Young et al. | |
| 6,256,789 | B1 * | 7/2001 | Young | E04G 5/001 2/69 |
| 6,637,547 | B1 | 10/2003 | Wydner | |
| 6,698,026 | B2 | 3/2004 | Schweer | |
| 7,707,652 | B2 | 5/2010 | Senegal | |
| 7,757,304 | B1 * | 7/2010 | Real | A41D 13/0007 2/69 |
| 8,375,467 | B2 | 2/2013 | Real et al. | |
| 8,430,204 | B1 | 4/2013 | Reynolds | |
| 8,776,266 | B1 * | 7/2014 | Metz | A41D 13/0007 2/94 |
| 9,855,450 | B2 * | 1/2018 | Remler | A62B 35/0018 |
| 2004/0244097 | A1 | 12/2004 | Kassai et al. | |
| 2005/0278819 | A1 * | 12/2005 | Munn | A41D 13/0007 2/69 |
| 2007/0044197 | A1 | 3/2007 | Turcotte et al. | |
| 2008/0164095 | A1 | 7/2008 | Snedeker | |
| 2008/0256678 | A1 * | 10/2008 | Grilliot | A62B 35/0037 2/69 |
| 2008/0289086 | A1 * | 11/2008 | Grilliot | A41D 13/0007 2/455 |
| 2010/0282541 | A1 * | 11/2010 | Renton | A62B 1/18 182/234 |
| 2011/0030118 | A1 | 2/2011 | Pratchett | |
| 2013/0341123 | A1 | 12/2013 | McMahon | |
| 2016/0278454 | A1 * | 9/2016 | Lucas | A41D 13/0007 |
| 2017/0001049 | A1 * | 1/2017 | Zeppetella | A62B 35/0006 |
| 2019/0054328 | A1 * | 2/2019 | Bhaskarwar | A62B 35/0075 |
| 2019/0069610 | A1 * | 3/2019 | Samaniego | A41D 13/0002 |
| 2019/0082750 | A1 * | 3/2019 | Matuszak | A41D 27/00 |
| 2020/0060357 | A1 * | 2/2020 | Duran | A41D 1/02 |
| 2020/0078616 | A1 * | 3/2020 | Derrick | A62B 35/0037 |

OTHER PUBLICATIONS

Form PCT/ISA/210 International Search Report dated May 19, 2017 in relation to PCT/CA2016/051077, filed on Sep. 13, 2016.

* cited by examiner

OUTERWEAR GARMENT FOR USE WITH A FALL-ARREST HARNESS

BACKGROUND

Various types of safety body garments are known in the prior art. However, what is needed is an outerwear garment for use with a fall-arrest harness including a rear side Dee-ring access flap which permits the fall-arrest harness to be worn underneath the outerwear garment and then exposed for safe attachment to an anchor of a personal fall-arrest system to arrest a wearer in a fall from a working level.

FIELD

The present relates to safety body garments, and more particularly, to an outerwear garment for use with a fall-arrest harness that includes a quick-release Dee-ring access flap on a rear side of the outerwear garment that normally covers the fall-arrest harness until needed for use.

SUMMARY

The general purpose of the present outerwear garment for use with a fall-arrest harness, described subsequently in greater detail, is to provide an outerwear garment for use with a fall-arrest harness which has many novel features that result in an outerwear garment which may be safe to use with a fall-arrest harness.

To accomplish this, the present outerwear garment for use with a fall-arrest harness is devised to improve workplace safety by eliminating the practice of wearing a traditional fall-arrest harness over an outerwear garment, such as a jacket or vest. This practice is often associated with workers failing to wear their harnesses in a properly fastened state at all times while on the job as workers often fail to sufficiently tighten fall-arrest harnesses over such garments, leading to potential injuries or death should a fall event occur. In cases in which workers must frequently put on and take off such garments, the temptation to fail to properly wear and connect the harnesses is present. If the harness is worn over bulky clothing, as needed during cold weather, the harness restricts movement and prevents the harness from properly working. If a worker wears a harness under an outerwear garment, the movement of the lanyard is restricted. In the event of a fall, the force on the lanyard and angle of the lanyard and harness can result in outwear garment choking or wrenching the body of the worker. The present device may address the foregoing problems by providing an outerwear garment body with an aperture in the rear side thereof and Dee-ring access flap that covers the aperture. A plurality of releasably engageable two-part fasteners is disposed on each of the rear side adjacent the Dee-ring access flap and along the perimeter of the Dee-ring access flap to permit the Dee-ring access flap to be automatically opened. The access flap includes an inverted right-trapezoidal upper portion and a rectangular lower portion. A plurality of lanyard hook-receiving members is disposed on the front side of the garment body to provide a means for hanging the lanyard hooks during periods of non-use to prevent the harness from being damaged such as, for example, by being dragged on the ground. The present device may allow the wearer to properly wear the fall-arrest harness while wearing an outerwear garment without impeding proper use of the fall-arrest harness and without restricting movement of the lanyard, thus relieving the impact of any force the outerwear garment could otherwise have had on the wearer.

Thus has been broadly outlined a number of features of the present outerwear garment for use with a fall-arrest harness so that the detailed description thereof that follows may be better understood and in order that the present contribution to the art may be better appreciated.

According to an aspect, there is provided an outerwear garment for use by a user wearing a fall-arrest harness, the outerwear garment comprising: an outerwear garment body having at least a front side and a rear side; a Dee-ring access flap disposed on the garment body, the access flap having an upper side extending generally horizontally along the garment body, the access flap further having a right side and a left side; an aperture disposed on the garment body beneath the access flap, that exposes a Dee-ring of the fall-arrest harness when worn by the user underneath the outerwear garment, wherein the access flap is configured to cover the aperture; a plurality of fasteners disposed on each of the access flap and the garment body adjacent the right side and the left side of the access flap, the fasteners being configured to automatically release the access flap from the outerwear garment body when a tension in a lanyard extending from the Dee-ring of the fall-arrest harness approaches approximately a weight of the user; wherein the aperture allows at least a portion of the fall-arrest harness to extend therethrough, and thereby prevents the fall-arrest harness from displacing the outerwear garment body to substantially restrict the user's breathing when the lanyard has a tension approximately equal to the weight of the user.

According to another aspect, there is provided an outerwear garment for use with a fall-arrest harness comprising: an outerwear garment body having a front side, a rear side, a pair of sleeves, a collar, and a front closure centrally disposed along a vertical midline axis of the front side; a right-trapezoidal Dee-ring access flap disposed in an inverted position on the rear side of the garment body, the access flap having an upper side continuously extending along each of a shoulder seam of the garment body and a rear portion of collar, the access flap further having a right side, a left side, and a lower side, the lower side being shorter than the upper side and centered on the rear side of the garment body; an aperture disposed on the rear side, the aperture having a same configuration as a configuration of the access flap, wherein the access flap is configured to cover only the aperture; a plurality of two-part fasteners disposed directly on each of the access flap and the garment body rear side directly adjacent the right side, the left side, and the lower side of the access flap, the fasteners being configured to automatically disengage and release the access flap from the outerwear garment body when a lanyard of a fall-arrest harness is pulled upwardly; a plurality of lanyard hook-receiving members disposed on the front side of the garment body, wherein a first pair of the lanyard hook-receiving members is disposed proximal the front closure and a second pair of the lanyard hook-receiving members is disposed approximately midway between the front closure and each of a side seam of the garment body proximal a bottom edge of the garment body; and a plurality of pockets, wherein at least a pair of the pockets is disposed on the front side in a vertical position parallel to the second pair of lanyard hook-receiving members and more proximal the garment body side seams than the lanyard hook-receiving members; wherein the access flap has surface area, wherein the surface area of the access flap is configured to cover a fall-arrest harness disposed between the access flap and an item of clothing worn by a user to cover the user's upper torso.

BRIEF DESCRIPTION OF THE DRAWINGS

Figures

DETAILED DESCRIPTION OF THE DRAWINGS

Figure 1:
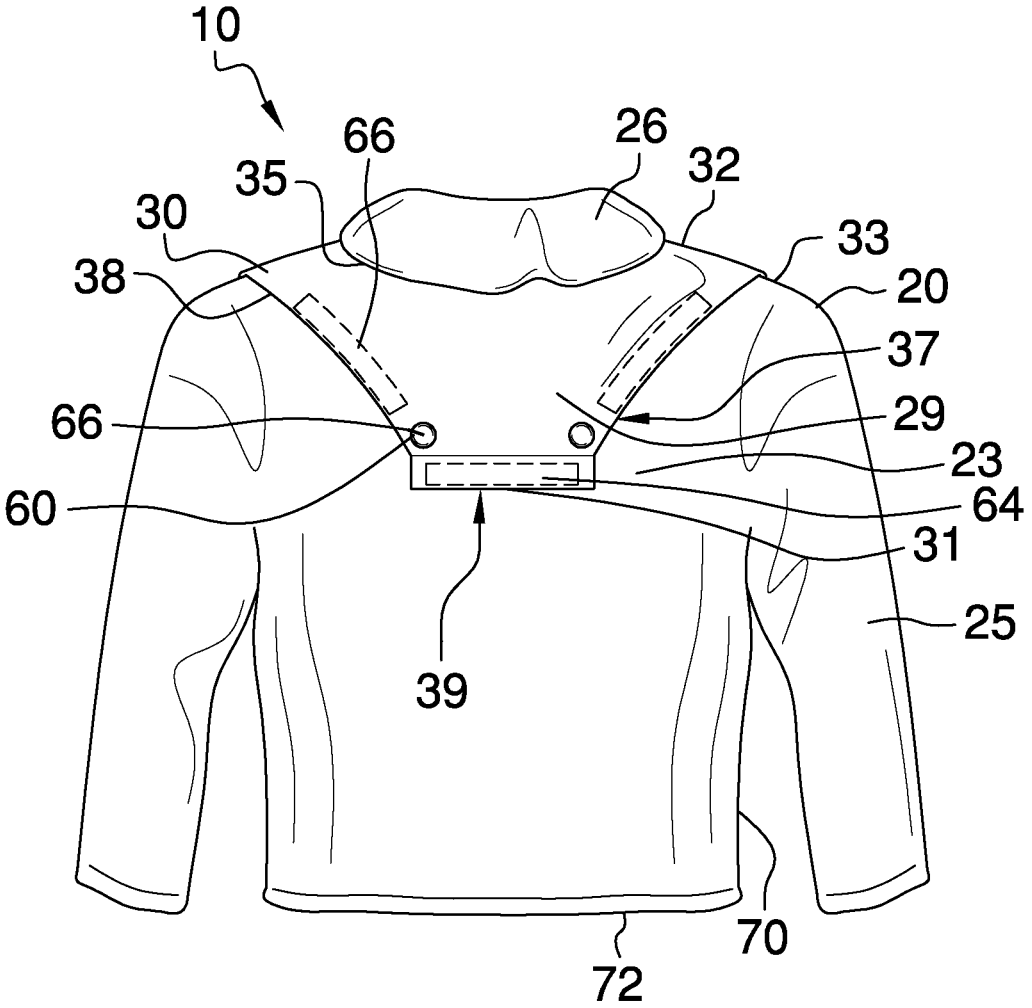
FIG. 1 is a rear elevation view of an outerwear garment showing a Dee-ring access flap in a closed position, exemplary of an embodiment.

With reference now to the drawings, and in particular FIGS. 1 through 9 thereof, examples of an outerwear garment for use with a fall-arrest harness and generally designated by the reference number 10 will be described. Device 10 is devised to eliminate the practice of having to wear a traditional fall-arrest harness over an outerwear garment, and instead to enable a traditional fall-arrest harness to be worn underneath the outerwear garment, and thus may increase workplace safety.

Referring to FIGS. 1 through 9, embodiments of an outerwear garment 10 for use with a fall-arrest harness are illustrated. In some embodiments, outerwear garment 10 for use with a fall-arrest harness includes an outerwear garment body 20, such as a jacket, a rain coat, a vest, or a winter coat. As shown, garment body 20 has at least a front side 22 and a rear side 23. The garment body 20, as shown in the drawings, may also include any one or a combination of a front closure 28, such as a zipper or at least one button, centrally disposed along a vertical midline axis of the front side 22, a pair of sleeves 25, and a collar 26. The outerwear garment body 20, in the form of a vest, would generally not include the sleeves 25 and may or may not include a collar 26. An aperture 27 is disposed on garment body 20, for example, on the rear side 23.

A Dee-ring access flap 29 is disposed to cover the aperture 27, for example, on rear side 23. A fall-arrest harness is worn prior to use between the access flap 29 and, for example, an item of clothing worn by a user to cover the user's upper torso. In the embodiment shown in FIGS. 1 and 3, access flap 29 has a right-trapezoidal upper portion 30 disposed in an inverted position on the rear side 23 and a rectangular lower portion 31 conjoined to the upper portion 30. The upper portion 30 has an upper side 32 that extends generally horizontally along garment body 20, for example, along each of a shoulder seam 33 of the garment body 20 as well as a rear portion 35 of collar 26. The access flap 29 has a right side 37, a left side 38, and a lower side 39. The lower side 39 is shorter than the upper side 32 and is centered on the rear side 23 of the outerwear garment body 20. The access flap 29 has surface area configured to cover a fall-arrest harness disposed between the access flap 29 and an item of clothing worn, such as a shirt, by a user to cover the user's upper torso. The aperture 27 may have the same configuration as the access flap 29.

The term fall-arrest harness as used herein is a harness secured to a wearer to distribute the fall-arrest forces over various parts of the wearer's body with means for attaching the fall-arrest harness to anchoring components of a personal fall-arrest system to arrest the wearer in a fall from a working level.

A plurality of fasteners, for example, two-part fasteners 60, are configured to allow for the automatic opening of the access flap 29 when a lanyard extending from the Dee-ring of a fall-arrest harness is pulled upwardly The plurality of fasteners, such as two-part fasteners 60, may be disposed, for example, on each of the access flap 29 and the outerwear garment body 20 rear side 23 adjacent the right side 37, the left side 38, and the lower side 39 of the access flap 29. Two-part fasteners 60 may be, for example, one of a hook and loop fastener 64 and a snap fastener 66, that disengage when a lanyard extending from the Dee-ring of a fall-arrest harness is pulled upwardly. Hook and loop fastener 64 may form a strip, for example, between one and two inches in width.

In some embodiments, one or more of the plurality of fasteners may be formed as one or more fastener seams formed by one or more rows of stitches sewn between access flap 29 and outwear garment body 20. Each stitch of a fastener seam may be a loop or a portion of at least one thread passing through access flap 29 and outerwear garment body 20, for example a lock stitch formed by two threads.

The fastener seams are configured to tear or separate when a lanyard extending from the Dee-ring of a fall-arrest harness is pulled upwardly. In such a configuration, the fastener seam may act as a point of failure, such that the fastener seam may tear or separate before the failure of another seam or fabric of the outerwear garment, for example, shoulder seam 33, when a lanyard extending from the Dee-ring of a fall-arrest harness is pulled upwardly.

In some embodiments, one or more of the plurality of fasteners, for example fastener seams, are configured to tear or separate, releasing access flap 29 from the outwear garment body 20, when a tension in a lanyard extending from the Dee-ring of a fall-arrest harness approaches approximately equal to a user's weight, the user's weight being the gravitational force on a user's mass. As such, a tension force exerted by the lanyard will approximately equal a user's weight, for example, when the user is suspended mid-air by the fall-arrest harness, the lanyard extending generally vertically from the Dee-ring of the fall-arrest harness. This may occur, for example, if the user slips and shortly before being caught by the fall-arrest harness in mid-air.

To achieve tearing or separation when tension in the lanyard approaches approximately a user's weight, the user's weight being approximately 100-200 lbs, preferably between 150-175 lbs, the combination of fabric of access flap 29 and outwear garment body 20 and one or more fastener seams may be such that each stitch of the one or more fastener seams may, for example, be 2 mm to 4 mm in length, forming a row of stitching 20 mm to 30 mm in length, of which one to three rows of stitching form a fastener seam. A fastener seam may extend perpendicularly with reference to shoulder seam 33. The thread used for a stitch may be a cotton or synthetic material, and may have a mass, for example between tex 40 and tex 45, where tex is the mass in grams of 1,000 meters of thread.

The opening of the access flap 29 permits access to, exposure, and use of the Dee-ring of the fall-arrest harness worn underneath the garment body 20, for anchoring the wearer to an anchor point to prevent falling from the precarious situation. The fasteners may permit the access flap 29 to open for use of the fall-arrest harness without substantially pulling the garment body 20 out of position. For example, with access flap 29 open, aperture 27 may allow at least a portion of the fall-arrest harness to extend therethrough, thereby preventing the fall-arrest harness from displacing the garment body 20 in such a way that would substantially restrict the user's breathing when a lanyard extending from the Dee-ring of the fall-arrest harness has a tension approximately equal to the weight of the user. This may occur, for example, when the user slips and is caught by the fall-arrest harness.

Aperture 27 may be approximately as wide as the distance between back straps of the fall-arrest harness positioned on a user's shoulders, to allow at least a portion of the fall-arrest harness to extend therethrough. For example, aperture 27 may allow at least a portion of back straps of the fall-arrest harness, and a back pad assembly connecting the Dee-ring to the back straps, to extend therethrough when the lanyard is pulled upwardly. The access flap 29 also permits the outerwear garment body to be reused.

Figure 2:
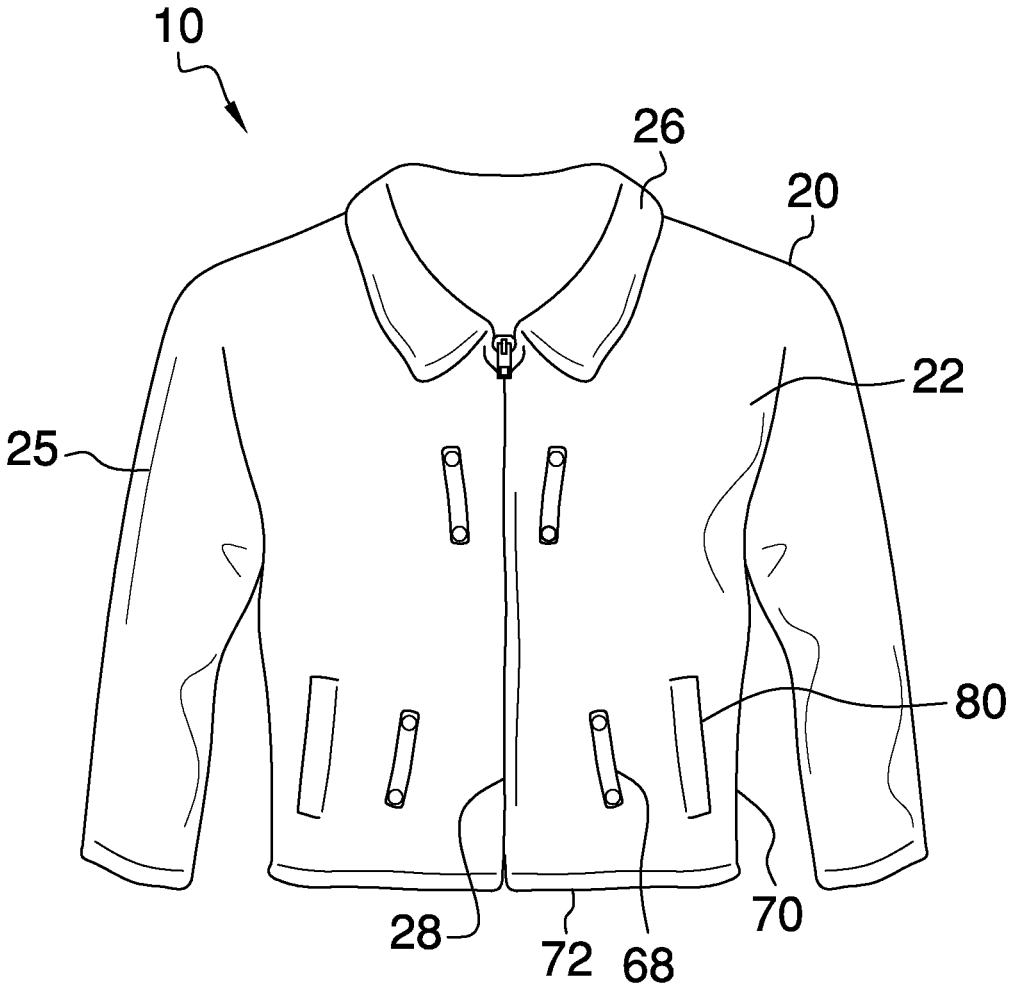
FIG. 2 is a front elevation view of the outerwear garment of FIG. 1.
Figure 3:
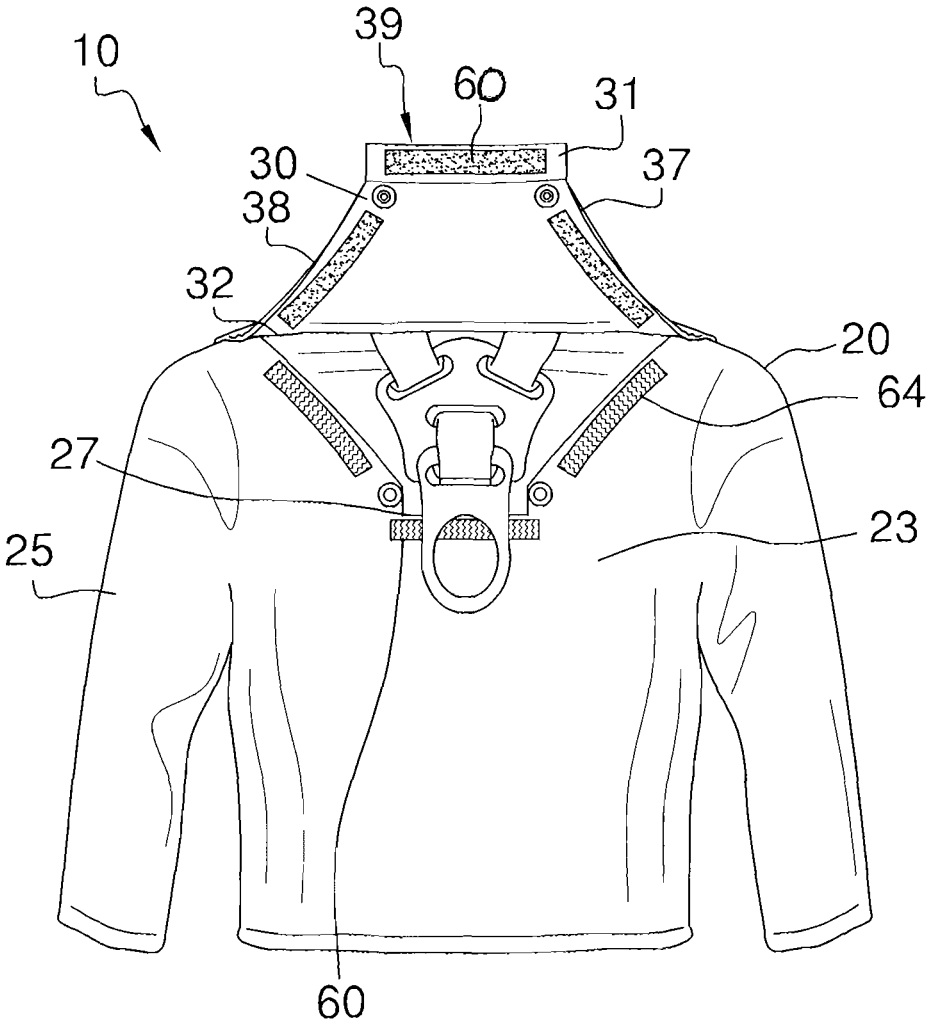
FIG. 3 is a rear elevation view of the outerwear garment of FIG. 1 showing the access flap in an open condition.
Figure 4:
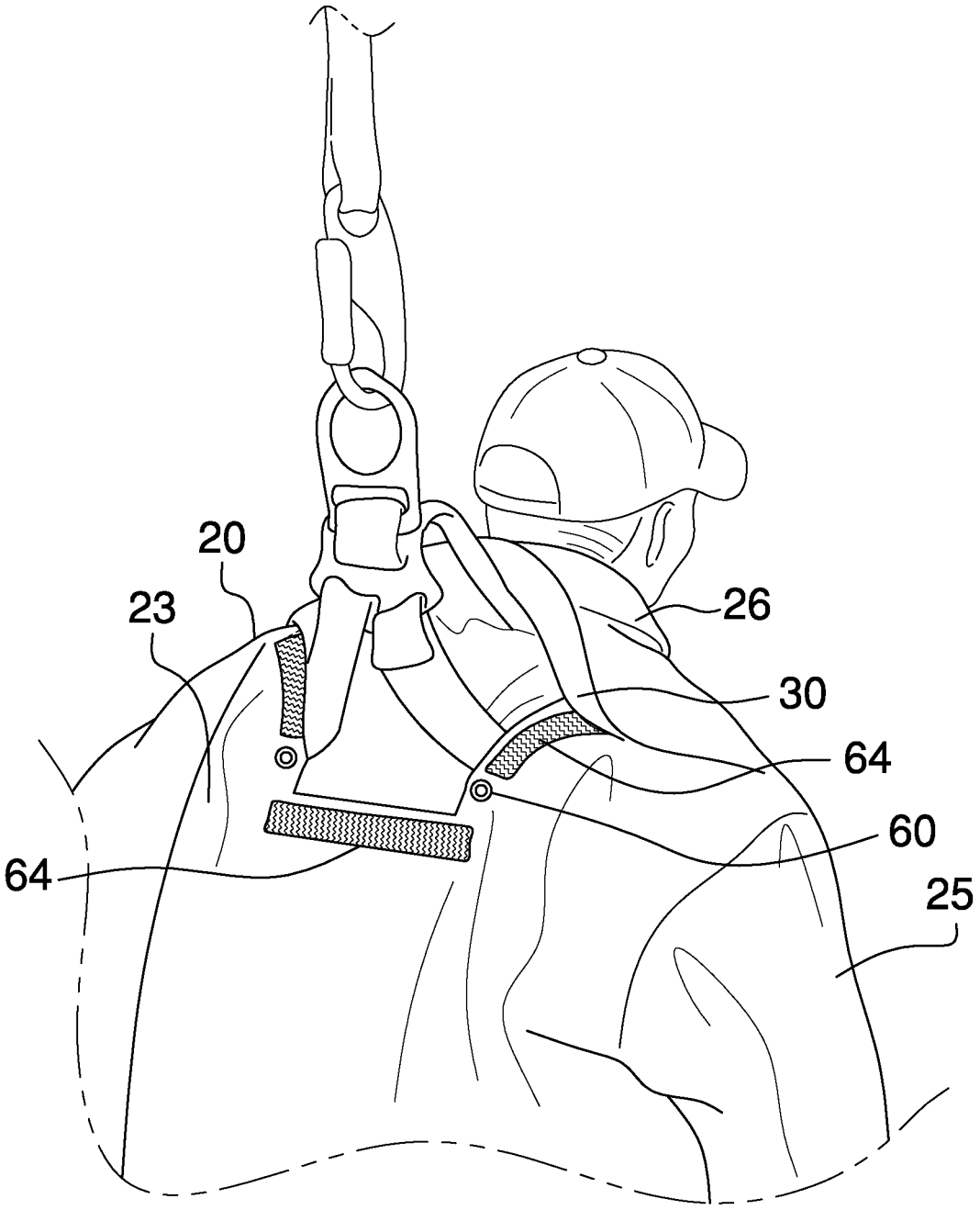
FIG. 4 is an in-use rear elevation view of the outerwear garment of FIG. 1 showing the access flap in an open condition and a fall-arrest harness extended with the Dee-ring attached to a lanyard.
Figure 5:
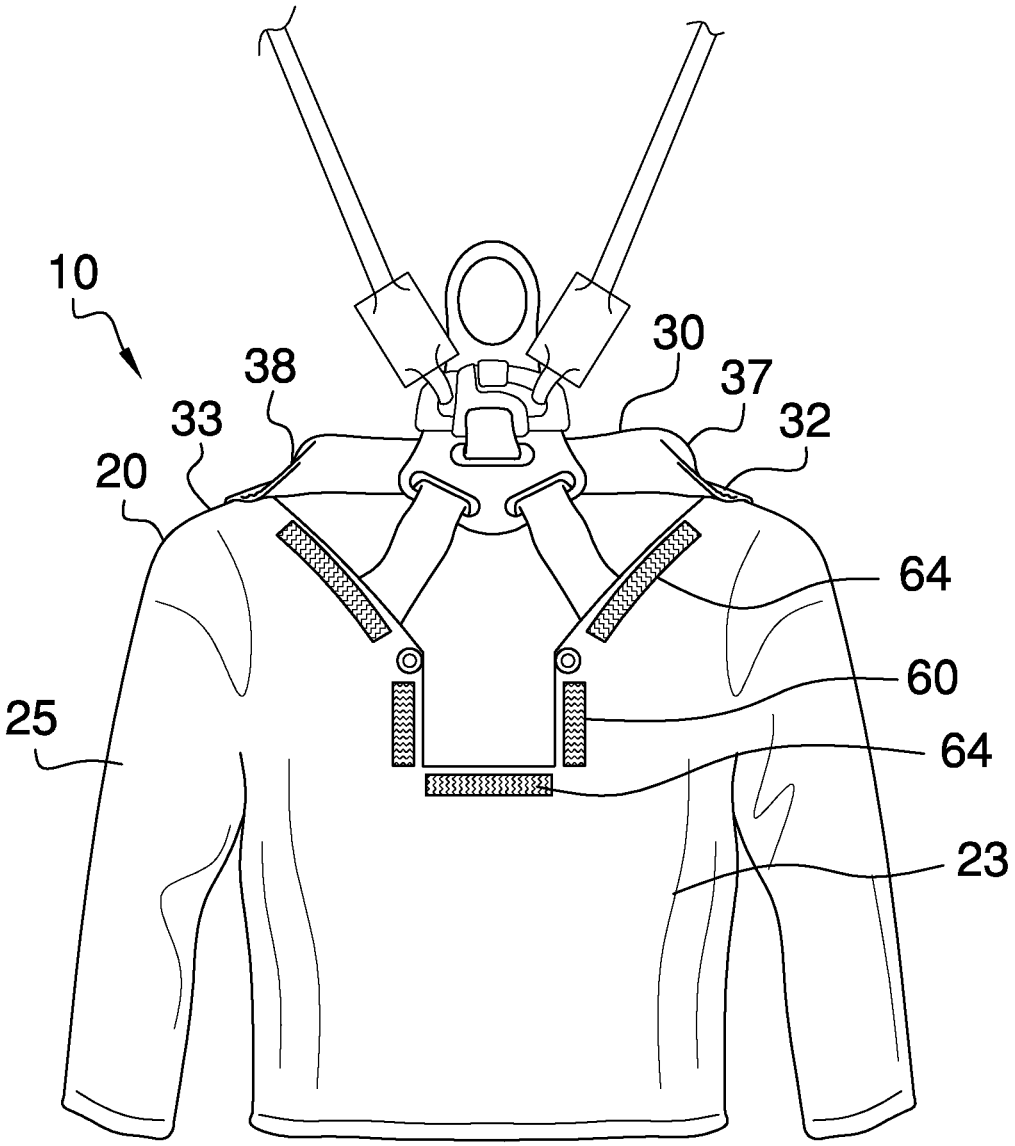
FIG. 5 is a rear elevation view of an outerwear garment showing the fall-arrest harness completely extended and the access flap in an open condition, exemplary of an embodiment.
Figure 6:
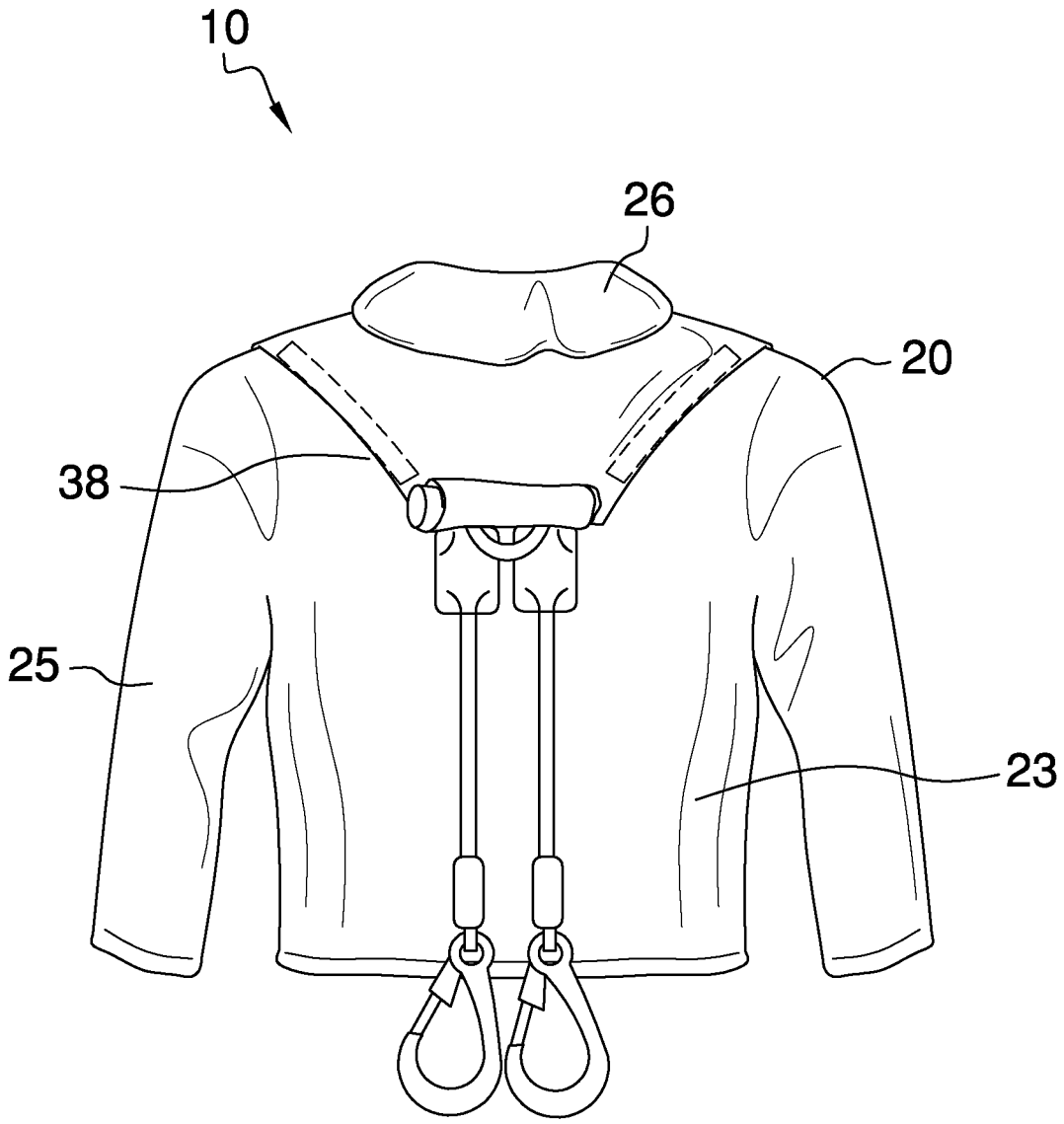
FIG. 6 is an in-use rear elevation view of an outerwear garment showing the access flap in a partially open condition showing a pair of lanyard hooks of a retractable lanyard fall-arrest harness extending out of the access flap, exemplary of an embodiment.
Figure 7:
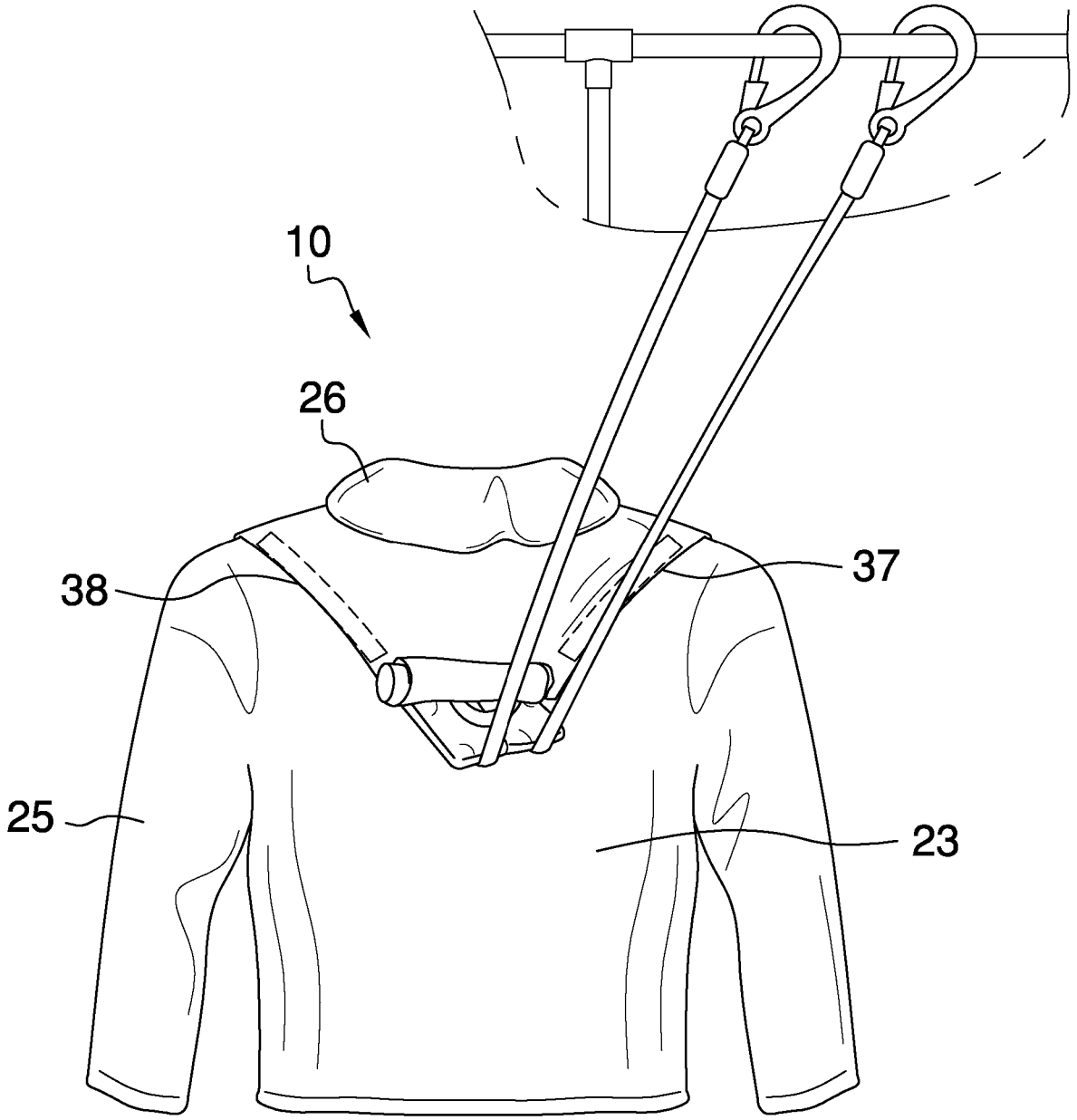
FIG. 7 is an in-use rear elevation view of the outerwear garment of FIG. 6 showing the access flap in a substantially closed position with the reels and straps of a retractable lanyard of the fall-arrest harness extending out of the access flap having a lanyard hook on the end of each lanyard attached to an anchoring member.
Figure 8:
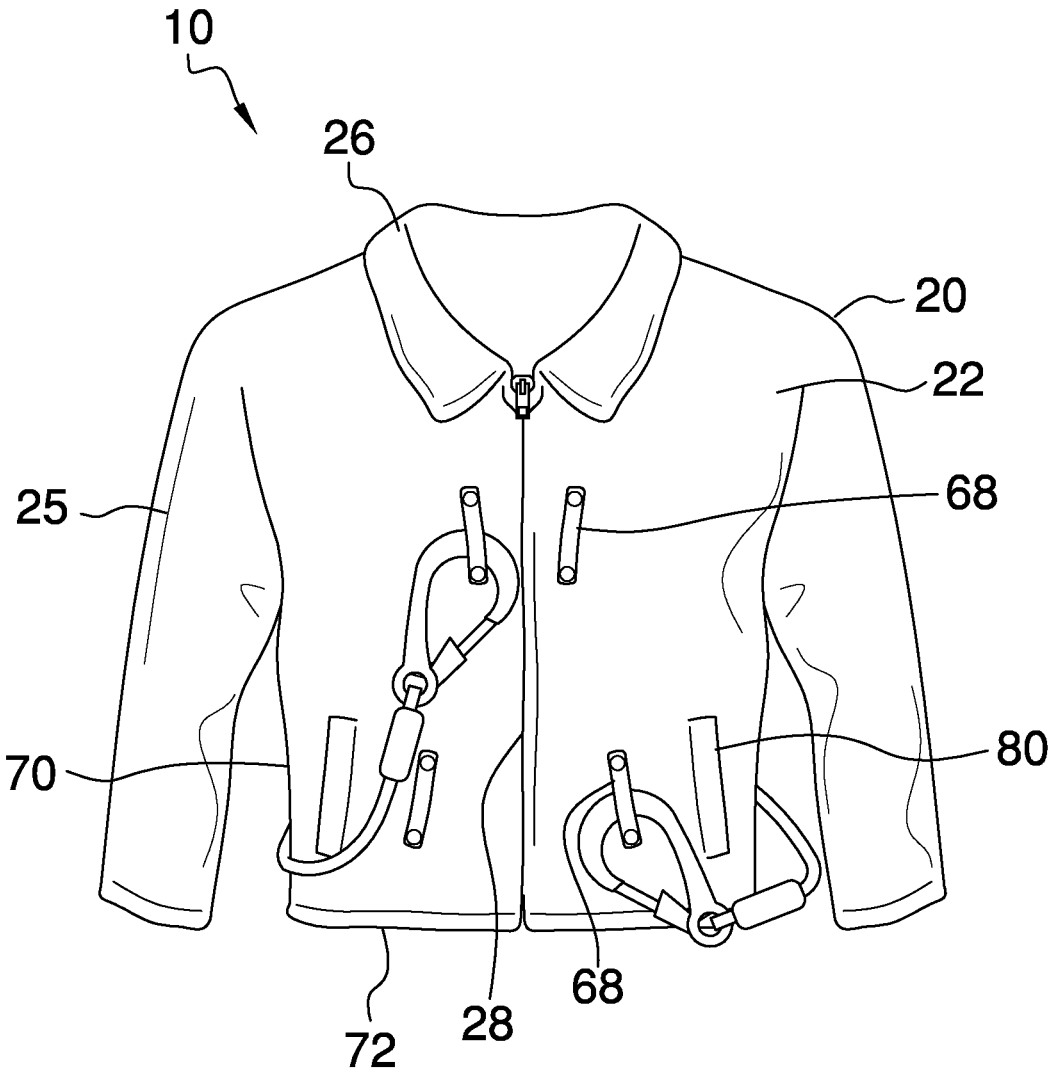
FIG. 8 is an in-use front elevation view of the outerwear garment of FIG. 6 showing a lanyard hook attached to each of a pair of lanyard hook-receiving members on a front side of an outerwear garment body when the lanyard hooks are not being used for fall-arrest of the wearer.
Figure 9:
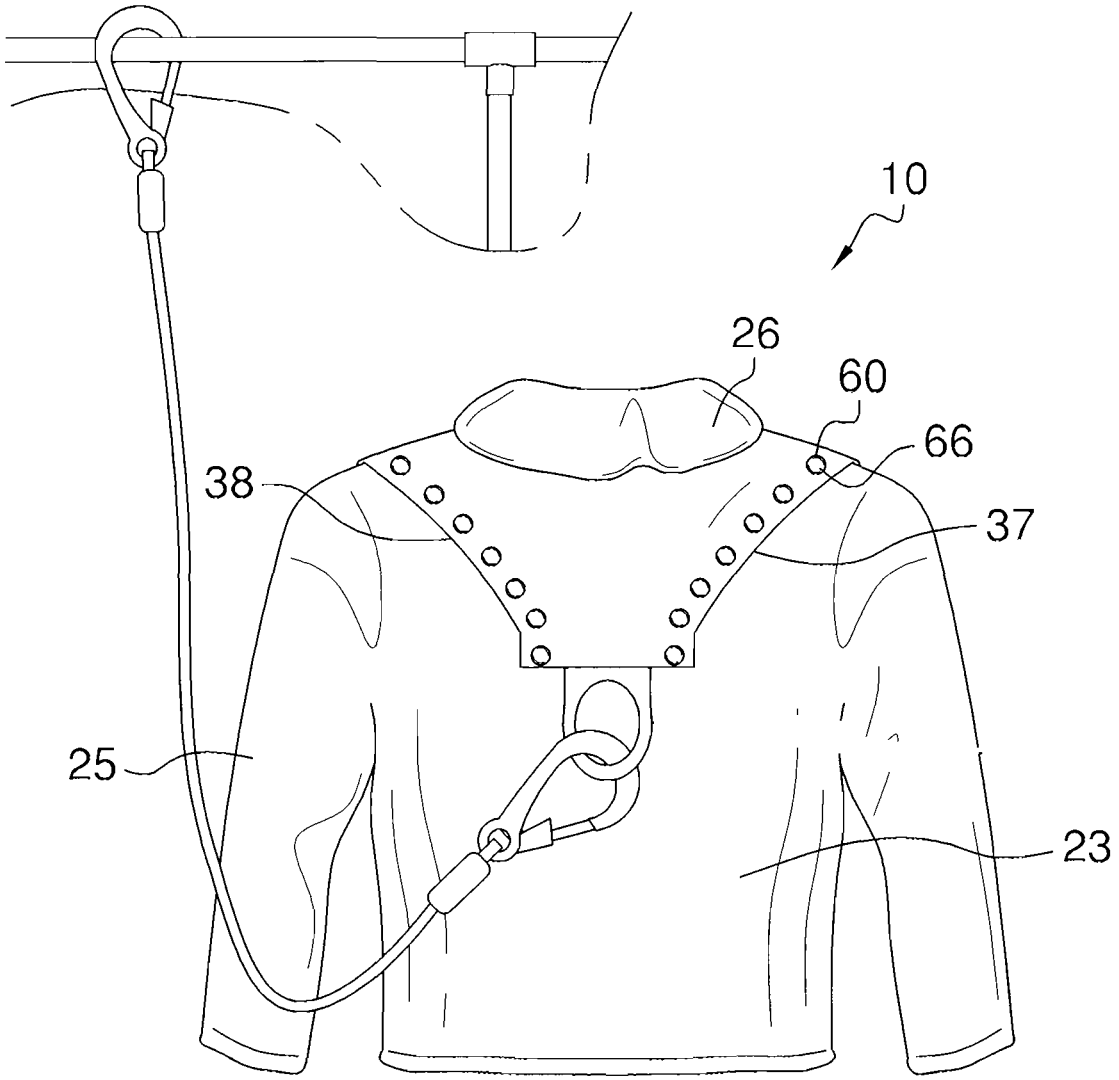
FIG. 9 is a rear elevation view of an outerwear garment showing a plurality of fasteners in the form of snap fasteners disposed along the access flap, exemplary of an embodiment.

In some embodiments, a plurality of lanyard hook-receiving members 68 is disposed on the front side 22 of the outerwear garment body 20. As shown in FIG. 2, one pair of the lanyard hook-receiving members 68 is disposed proximal the front closure 28, while another pair of the lanyard hook-receiving members 68 is disposed approximately midway between the front closure 28 and each of a side seam 70 of the outerwear garment body 20 proximal a bottom edge 72 of the garment body 20. The lanyard hook-receiving members 68 provide a means for hanging the lanyard hooks thereon during periods of non-use to prevent the fall-arrest harness from being damaged such as, for example, by being dragged on the ground. The outerwear garment body 20 can also include a plurality of pockets 80.

What is claimed is:

1. An outerwear garment for use by a user wearing a fall-arrest harness, the outerwear garment comprising:

an outerwear garment body having at least a front side, a rear side, a collar, and a front closure centrally disposed along a vertical midline axis of the front side;

a right-trapezoidal Dee-ring access flap disposed in an inverted position on the rear side of the garment body, the access flap having an upper side disposed on the garment body and extending generally horizontally along each of a shoulder seam of the garment body and a rear portion of the collar, the access flap further having a right side, a left side, and a lower side, the lower side of the access flap being shorter than the upper side of the access flap and centered on the rear side of the garment body;

a right-trapezoidal aperture disposed in an inverted position on the rear side of the garment body beneath the access flap that exposes a Dee-ring of the fall-arrest harness when worn by the user underneath the outerwear garment, the aperture having an upper side continuously extending generally horizontally along the garment body, a right side, a left side, and a lower side, the lower side of the aperture being shorter than the upper side of the aperture, wherein the access flap is configured to cover the aperture;

a plurality of fasteners disposed on each of the access flap and the garment body adjacent the right side and the left side of the access flap, the fasteners being configured to automatically release the access flap from the outerwear garment body when a tension in a lanyard extending from the Dee-ring of the fall-arrest harness approaches approximately a weight of the user;

a plurality of lanyard hook-receiving members disposed on the front side of the garment body, wherein a first pair of the lanyard hook-receiving members is disposed proximal to the front closure and a second pair of the lanyard hook-receiving members is disposed between the front closure and each of a side seam of the garment body proximal to a bottom edge of the garment body;

a plurality of pockets, wherein at least a pair of the pockets is disposed on the front side parallel to the second pair of lanyard hook-receiving members and more proximal to the garment body side seams than the lanyard hook-receiving members;

wherein the aperture allows at least a portion of the fall-arrest harness to extend therethrough, and thereby prevents the fall-arrest harness from displacing the outerwear garment body to substantially restrict the user's breathing when the lanyard has a tension approximately equal to the weight of the user.

2. The outerwear garment of claim 1, wherein the aperture allows at least a portion of back straps of the fall-arrest harness, and a back pad assembly connecting the Dee-ring to the back straps, to extend therethrough when the lanyard is pulled upwardly.

3. The outerwear garment of claim 1, further comprising an additional plurality of fasteners disposed on each of the access flap and the garment body adjacent the lower side of the access flap.

4. The outerwear garment of claim 1, wherein the plurality of fasteners comprise two-part fasteners.

5. The outerwear garment of claim 1 wherein the second pair of the lanyard hook-receiving members is disposed approximately midway between the front closure and each of a side seam of the garment body proximal a bottom edge of the garment body.

6. An outerwear garment for use with a fall-arrest harness comprising:

an outerwear garment body having a front side, a rear side, a pair of sleeves, a collar, and a front closure centrally disposed along a vertical midline axis of the front side;

a right-trapezoidal Dee-ring access flap disposed in an inverted position on the rear side of the garment body, the access flap having an upper side continuously extending along each of a shoulder seam of the garment body and a rear portion of the collar, the access flap further having a right side, a left side, and a lower side, the lower side of the access flap being shorter than the upper side of the access flap and centered on the rear side of the garment body;

a right-trapezoidal aperture disposed in an inverted position on the rear side, the aperture having an upper side continuously extending generally horizontally along the garment body, a right side, a left side, and a lower side, the lower side of the aperture being shorter than the upper side of the aperture and centered on the rear side of the garment body, wherein the access flap is configured to cover the aperture;

a plurality of two-part fasteners disposed directly on each of the access flap and the garment body rear side directly adjacent the right side, the left side, and the lower side of the access flap, the fasteners being configured to automatically disengage and release the access flap from the outerwear garment body when a lanyard of a fall-arrest harness is pulled upwardly;

a plurality of lanyard hook-receiving members disposed on the front side of the garment body, wherein a first pair of the lanyard hook-receiving members is disposed proximal the front closure and a second pair of the lanyard hook-receiving members is disposed approximately midway between the front closure and each of a side seam of the garment body proximal a bottom edge of the garment body; and a plurality of pockets, wherein at least a pair of the pockets is disposed on the front side in a vertical position parallel to the second pair of lanyard hook-receiving members and more proximal the garment body side seams than the lanyard hook-receiving members;

wherein the access flap has surface area, wherein the surface area of the access flap is configured to cover a fall-arrest harness disposed between the access flap and an item of clothing worn by a user to cover the user's upper torso.

7. The outerwear garment for use with a fall-arrest harness of claim 6 wherein each two-part fastener is one of a hook and loop fastener, and a snap fastener.

* * * * *